US005317995A

United States Patent [19]

Brümmer et al.

[11] Patent Number: 5,317,995

[45] Date of Patent: Jun. 7, 1994

[54] INTAKE PIPE FOR AN INTERNAL COMBUSTION ENGINE

[75] Inventors: Michael Brümmer, Laudenbach; Detlef Cordts, Mörlenbach; Klaus Döhring, Heidelberg, all of Fed. Rep. of Germany

[73] Assignee: Firma Carl Freudenberg, Weinheim, Fed. Rep. of Germany

[21] Appl. No.: 54,988

[22] Filed: Apr. 29, 1993

[30] Foreign Application Priority Data

May 23, 1992 [DE] Fed. Rep. of Germany ..... 4217191

[51] Int. Cl.[5] ..... F02M 35/10; F02D 9/08

[52] U.S. Cl. ..... 123/52 MF; 137/899

[58] Field of Search ..... 123/52 MF, 52 MB, 198 D; 137/198 D; 285/299, 298, 903

[56] References Cited

U.S. PATENT DOCUMENTS

| | | | |
|---|---|---|---|
| 3,692,337 | 9/1972 | Mischel | 285/299 |
| 4,133,347 | 1/1979 | Mercer | 137/899 |
| 4,450,814 | 5/1984 | Sawamoto et al. | 123/198 D |
| 4,697,829 | 10/1987 | Pond | 285/299 |
| 5,009,199 | 4/1991 | MacFarlane | 123/52 MF |
| 5,150,669 | 9/1992 | Rush et al. | 123/52 MF |

*Primary Examiner*—Tony M. Argenbright
*Assistant Examiner*—M. Macy
*Attorney, Agent, or Firm*—Kenyon & Kenyon

[57] ABSTRACT

An intake pipe assembly for an internal combustion engine is described. The intake pipe assembly includes an intake pipe and a safety valve which can be brought into an open position by the presence of a pressure on the inside of the intake pipe which exceeds a pressure of the surrounding atmosphere.

15 Claims, 4 Drawing Sheets

INTAKE PIPE FOR AN INTERNAL COMBUSTION ENGINE

BACKGROUND OF THE INVENTION

The present invention relates to an intake pipe for an internal combustion engine.

Intake pipes for internal combustion engines are generally known and typically consist of a metallic material or of a plastic. The wall thicknesses of these generally known intake pipes is frequently dimensioned such that a sudden increase in combustion pressure, such as may accompany a backfire into the intake pipe associated with the improper adjustment of an internal combustion engine, can be withstood without damage. In this connection, however, it must be taken into account that the wall thicknesses of such intake pipes are substantial, which is unsatisfactory from the standpoint of manufacture, economy and functionality. On the other hand, thin-walled plastic intake pipes frequently do not withstand sudden increases in pressure and burst.

There remains a need for intake pipes that can be efficiently manufactured, both from the standpoint of manufacturing technique and cost, and that are of low weight, yet which can withstand the combustion pressures which can arise upon backfire into the intake pipe.

SUMMARY OF THE INVENTION

The invention addresses this need by providing an intake pipe having a safety valve which can be brought into an open position by application of a level of pressure on the inside of the safety valve that may, for example, exceed the atmospheric pressure on the outside of the safety valve.

An advantage of the present invention is that the wall thicknesses of the intake pipe can be reduced, since the excess pressure which can occur inside the intake pipe is reduced via the safety valve. Such an intake pipe has good properties for use over a long period of time, can be manufactured in a simple, cost-effective manner, and is of low weight.

In accordance with a particularly simple embodiment of the present invention, the safety valve can consist of a tubular annular sleeve of an elastic material, such as rubber, that covers in a sealing manner at least one wall opening of a tap that is connected in an airtight fashion to the intake pipe. In the event of any excess pressure within the intake pipe and thus within the tap, the annular sleeve of rubber-elastic material is acted on by this pressure and is lifted from the surface of the tap, resulting in pressure equalization with the surrounding atmosphere. The annular sleeve is, in this case, displaced only in the radial direction. The attachment of the annular sleeve on the tap can be achieved, for instance, by a clamp, by a friction lock and/or by form-locking. The annular sleeve can, for instance, be provided with a projection on its inner circumference on the side of the annular sleeve facing the intake pipe. This projection can extend, for example, at least in part over the inner circumference of the annular sleeve and can be snapped into a circumferential groove which is provided on the tap and which opens in the direction of the annular sleeve.

According to another embodiment of the invention, the safety valve can consist of an annular sleeve of rubber/elastic material which surrounds, in a sealing manner, an opening in the wall of the intake pipe in the region of the outside diameter of the annular sleeve and which surrounds, in a similarly sealing manner, a tap in the region of the inside diameter of the annular sleeve. In the region of the wall opening of the intake pipe, the annular sleeve can be provided with reinforcement or stiffening ribs in order not to be distended through the wall opening in the direction of the intake pipe by the vacuum which usually exists inside the intake pipe.

According to yet another embodiment, the tap can be developed into a vacuum connection or a sensor connection. In accordance with one advantageous embodiment, it is provided that the annular sleeve be produced in the form of a bellows, that the bellows and the tap each have a matching surface profile and that the surface profiles can, upon application of a vacuum, be brought into engagement with each other in sealing manner. By producing the tap in the shape of a bellows, the two parts are applied against each other in gas-tight manner upon the action of a vacuum so that reliable pressure conditions can exist in the intake pipe for control of the engine. In the region of its axial ends, the annular sleeve can, for example, be reinforced by annular beads in order to assure that the position of the annular sleeve is fixed, at least in the region of the intake pipe upon the action of excess pressure. Upon the action of excess pressure inside the intake pipe, the outside diameter of the bellows remains in position in a substantially tight manner in the region of the wall opening, while the otherwise tight connection between the tap and the bellows opens and brings about a pressure equalization with the atmosphere. In this fashion, bursting of the intake pipe is prevented.

According to still another embodiment of the present invention, the annular sleeve and the tap can be developed as a single preassembled unit which can be designed for attachment to the intake pipe. The attachment of the preassembled unit can take place, for instance, by means of a snap-on type device which can be snapped into an opening of the intake pipe. Other attachment possibilities are also conceivable such as gluing or rotary friction welding.

BRIEF DESCRIPTION OF THE DRAWINGS

These and other features, aspects, and advantages of the present invention will become better understood with regard to the following description, appended claims, and accompanying drawings. The drawings show the corresponding individual components in sectional and in partially diagrammatic view.

DETAILED DESCRIPTION

FIGS. 1–4 show various embodiments of an intake pipe 4 for a internal combustion engine which is provided with a safety valve 1. The safety valve 1 can be brought into an open position by the exertion of a pressure on the inside 2 of the intake pipe 4 which exceeds surrounding atmospheric pressure.

Figure 1:
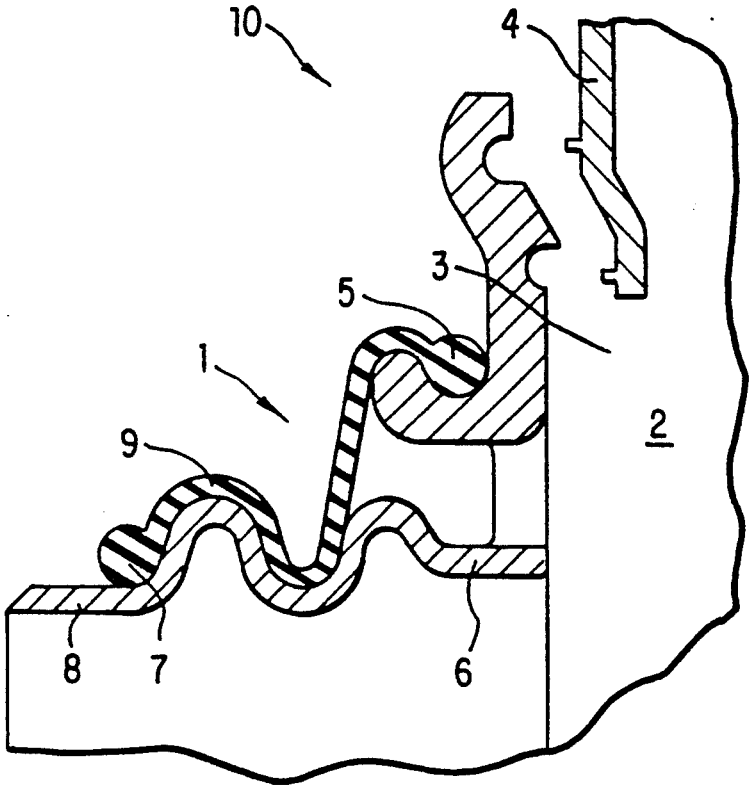
FIG. 1 is a sectional view of an embodiment of the invention in which a tap, which is developed as a vacuum connection, and an annular sleeve, which is developed as a bellows, are provided as a preassembled unit and are connected subsequently to an intake pipe, for example, by rotary friction welding.
Figure 2:
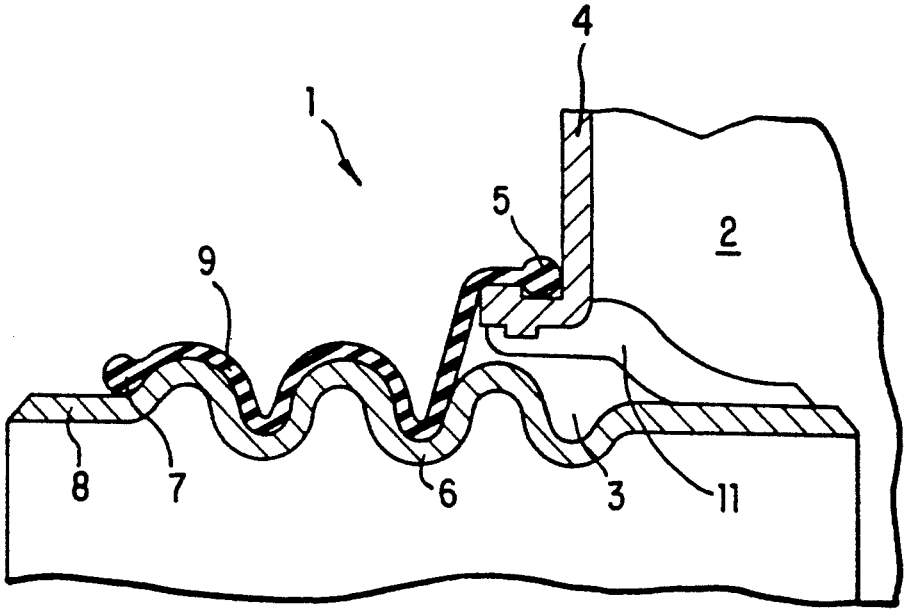
FIG. 2 is a sectional view of an embodiment of the invention in which an annular sleeve is fixed in position at one end on an intake pipe and at the other end on a tap. The tap is developed as a vacuum connection and can be snapped into the wall opening of the intake pipe.

In FIGS. 1 and 2, the safety valve 1 is formed using an annular sleeve of rubber/elastic material which is provided in the form of a bellows 9. Upon the action of a vacuum, the safety valve 1 seals off from the atmosphere wall opening 3, which can be associated, for example, with a vacuum connection 8. The vacuum connection 8 can, for instance, be coupled to the crankcase vent of the internal combustion engine.

In FIG. 1 the bellows 9 is associated with a preassembleable unit 10 having a vacuum connection 8. The outside diameter 5 of the bellows 9 is held in an undetachable manner in an undercut. The inside diameter 7 of the bellows 9 is supported on the vacuum connection 8 in a detachable manner. In the event of excess pressure on the inside 2 of the intake pipe 4, which can be formed for instance by combustion pressure in the case of an improperly adjusted internal combustion engine, the bellows 9 briefly lifts off from the vacuum connection 8 until the excess pressure in the intake pipe has been reduced to the point where it becomes equalized with atmospheric pressure. In order to improve the working properties of the safety valve 1, the bellows 9 can be provided, at least in the region of the wall opening 3 of the intake pipe 4, with reinforcement or stiffening ribs (not shown). The preassembleable unit 10 can be attached to the intake pipe 4 by friction welding, rotary welding or by snapping it into place.

Referring now to FIG. 2, a tap 6 is snapped into a wall opening 3 of an intake pipe 4. As in FIG. 1, the tap 6 is produced in association with a vacuum connection 8. The vacuum connection 8 is thereby fixed in space in an axial direction perpendicular to the wall of the intake pipe 4. An annular sleeve in the form of a bellows 9 is connected in the region of its outside diameter 5 to a recess which is developed integral with the intake pipe 4 and is connected in the region of its inside diameter 7 to the vacuum connection 8. The manner of operation of the safety valve 1 does not substantially differ from the operation of the embodiment of the safety valve 1 according to FIG. 1.

Figure 3:
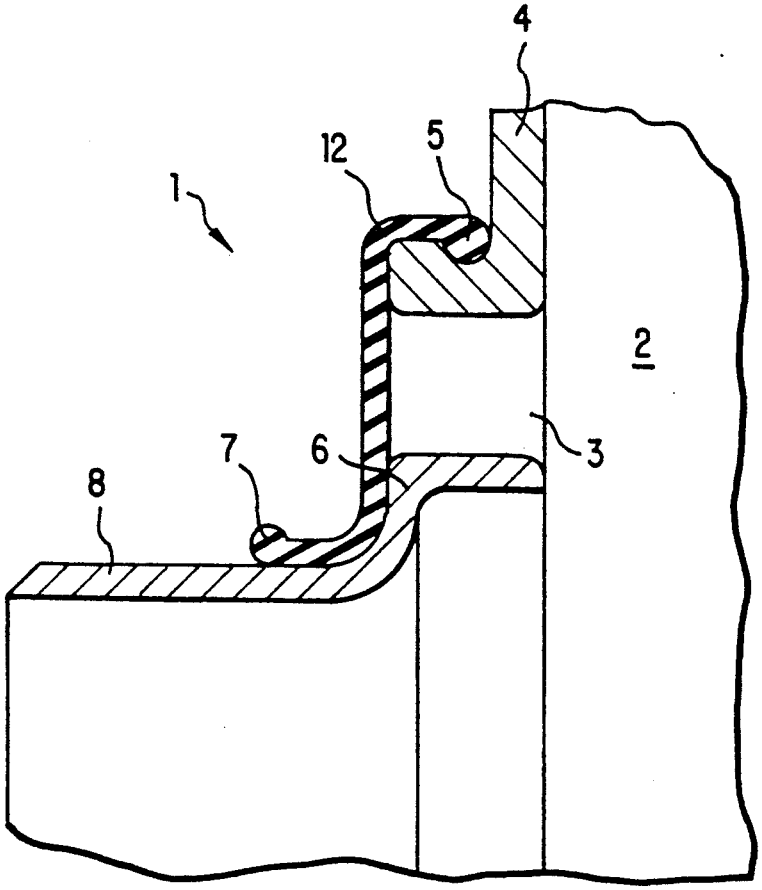
FIG. 3 is a sectional view of an embodiment of the invention in which an intake pipe is made integral with a tap developed as vacuum connection. The embodiment has wall openings which are closed by the annular sleeve upon the action of vacuum. The annular sleeve in this example is not developed as a bellows.

In FIG. 3, an intake pipe 4 is developed integral with a tap 6. Wall openings 3 are provided for the action of a vacuum/increase in pressure. The annular sleeve is, in this example, substantially s-shaped and has circumferential beads at its outside diameter 5 and its inside diameter 7. The region of the annular sleeve, which in the case of normal operation is acted on by vacuum through the wall openings 3, can be provided with a reinforcement member which results in consistently good properties over a long service life.

Figure 4:
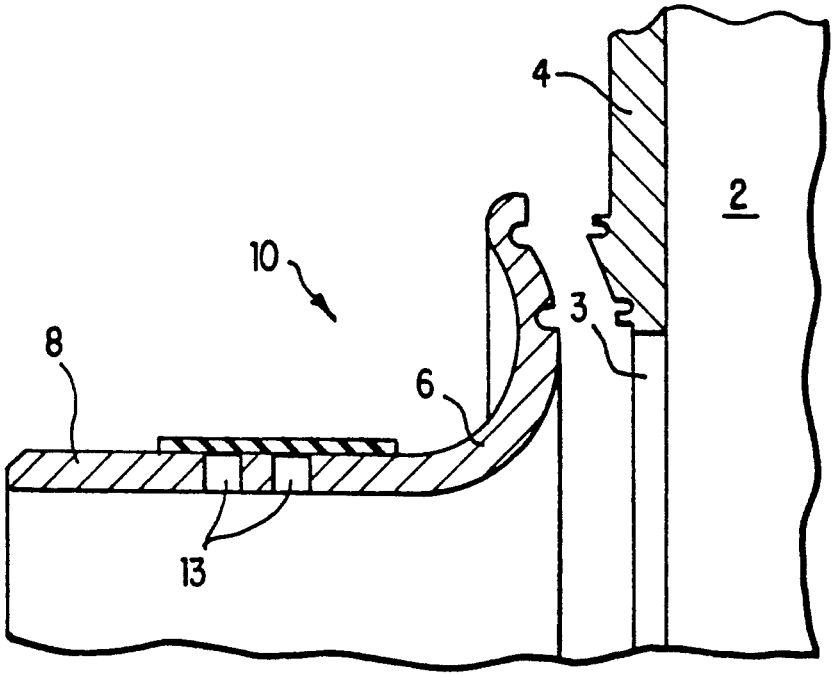
FIG. 4 is a sectional view of an embodiment of the invention wherein a safety valve is formed by a tubular annular sleeve which covers a wall opening of a tap.

FIG. 4 shows an embodiment similar to the embodiment of FIG. 1, wherein the annular sleeve is tubular and consists of a rubber/elastic material. The annular sleeve covers two wall openings 13 in the tap 6 which, in the same way as the tap 6 of the preceding figures, can be developed as a pipe or hose connection. The annular sleeve can, for instance, be held by a clamp to fix it in space on the tap 6. The preassembleable unit 10 can be attached to the intake pipe in the same manner as described, for example, with reference to FIG. 1.

With respect to FIGS. 1–4, both the intake pipes 4 and the vacuum connections 8, which is developed for example in two pieces with the intake pipe 4 in FIGS. 1 and 2, consist of a suitable plastic such as polyamide. Other appropriate materials may be used as well.

What is claimed is:

1. An intake pipe assembly for an internal combustion engine comprising:
   an intake pipe; and
   a safety valve which is brought into an open position by the direction application of a level of pressure on the inside of the intake pipe that exceeds a level of pressure of the surrounding atmosphere, wherein the safety valve comprises:
      a tap having at least one wall opening, said tap being connected in an air-tight manner to the intake pipe; and
   a tubular annular sleeve of elastic material, wherein the tubular annular sleeve of elastic material covers the at least one wall opening in the tap in a sealing manner when the level of pressure on the inside of the intake pipe is less than the level of pressure of the surrounding atmosphere.

2. The intake pipe according to claim 1, wherein the tap is a vacuum connection.

3. The intake pipe according to claim 1 wherein the tap is a sensor connection.

4. The intake pipe according to claim 1 wherein the annular sleeve and the tap are developed as a preassembleable unit which can be attached to the intake pipe.

5. An intake pipe assembly for an internal combustion engine comprising:
   an intake pipe;
   a wall opening provided int he intake pipe;
   a tap disposed within the opening in the intake pipe; and
   a safety valve which can be brought into an open position when a level of pressure on the inside of the intake pipe exceeds a level of pressure of the surrounding atmosphere, said safety valve comprising an annular sleeve of elastic material having an outside diameter and an inside diameter, wherein, when the level of pressure on the inside of the intake pipe is less than the level of pressure of the surrounding atmosphere, the annular sleeve of elastic material surrounds, in a sealing manner, the wall opening of the intake pipe in the region of its outside diameter and surrounds, in a sealing manner, the tap in the region of its inside diameter.

6. The intake pipe according to claim 5, wherein the tap is a vacuum connection.

7. The intake pipe according to claim 5 wherein the tap is a sensor connection.

8. The intake pipe according to claim 5 wherein the annular sleeve is a bellows and wherein the bellows and the tap are provided with complementary surface profiles which are brought into sealing engagement with one another when the level of pressure on the inside of the intake pipe is less than the level of pressure of the surrounding atmosphere.

9. The intake pipe according to claim 5 wherein the annular sleeve and the tap are developed as a preassembleable unit which can be attached to the intake pipe.

10. The intake pipe according to claim 8 wherein the annular sleeve and the tap are developed as a preassembleable unit which can be attached to the intake pipe.

11. The intake pipe according to claim 10 wherein the unit is provided with a snap-in device for attachment.

12. A safety valve for installation on an aperture of an internal combustion engine intake pipe, said safety valve comprising:

a tap for connection to the intake pipe; and an annular sleeve of elastic material which seals an internal region of the intake pipe from the surrounding atmosphere when a level of pressure on the inside of the intake pipe is less than a level of pressure of the surrounding atmosphere and which provides a pathway between the internal region and the surrounding atmosphere when the level of pressure in the internal region exceeds the level of pressure of the surrounding atmosphere.

13. The safety valve according to claim 12, wherein the tap has at least one wall opening and is designed for air-tight connection into the aperture of the intake pipe, and wherein the annular sleeve of elastic material covers the at least one wall opening in the tap in a sealing manner when the level of pressure on the inside of the intake pipe is less than the level of pressure of the surrounding atmosphere.

14. The safety valve according to claim 12, wherein the annular sleeve of elastic material has an outside diameter and an inside diameter such that, upon installation of the safety valve on the intake pipe and when the level of pressure on the inside of the intake pipe is less than the level of pressure of the surrounding atmosphere, the annular sleeve of elastic material surrounds the aperture of the intake pipe in the region of its outside diameter in a sealing manner and surrounds the tap in the region of its inside diameter in a sealing manner.

15. The safety valve according to claim 14 wherein the annular sleeve is a bellows and wherein the bellows and the tap are provided with complementary surface profiles which are brought into sealing engagement with one other when the level of pressure on the inside of the intake pipe is less than the level of pressure of the surrounding atmosphere.

* * * * *